US009024161B1

(12) United States Patent
Strong

(10) Patent No.: US 9,024,161 B1
(45) Date of Patent: May 5, 2015

(54) WIND CHIME SILENCER AND PROTECTOR

(71) Applicant: Jeffrey L. Strong, Fairfax, VA (US)

(72) Inventor: Jeffrey L. Strong, Fairfax, VA (US)

( * ) Notice: Subject to any disclaimer, the term of this patent is extended or adjusted under 35 U.S.C. 154(b) by 0 days.

(21) Appl. No.: 14/201,896

(22) Filed: Mar. 9, 2014

(51) Int. Cl.
*G10D 13/08* (2006.01)
*G10K 1/26* (2006.01)

(52) U.S. Cl.
CPC . *G10K 1/26* (2013.01); *G10D 13/08* (2013.01)

(58) Field of Classification Search
CPC ..... G10D 13/08; G10K 1/26
See application file for complete search history.

(56) References Cited

U.S. PATENT DOCUMENTS

| | | | | | |
|---|---|---|---|---|---|
| 864,461 | A | * | 8/1907 | Gibbs | 116/169 |
| D250,455 | S | * | 12/1978 | Mohrhauser | D10/116.1 |
| D279,873 | S | * | 7/1985 | Neely | D10/116.1 |
| D285,669 | S | * | 9/1986 | Brockmann | D10/118.1 |
| 4,854,214 | A | * | 8/1989 | Lowe | 84/404 |
| 4,967,633 | A | * | 11/1990 | Jewell, Jr. | 84/404 |
| D324,000 | S | * | 2/1992 | Kvistad | D10/118 |
| D332,924 | S | * | 2/1993 | Schutze | D10/118 |
| 5,450,779 | A | * | 9/1995 | Yancy | 84/404 |
| 5,648,624 | A | * | 7/1997 | Smith | 84/404 |
| 5,744,736 | A | * | 4/1998 | Chang | 84/402 |
| 5,980,056 | A | * | 11/1999 | West | 362/86 |
| D420,613 | S | * | 2/2000 | Williams | D10/116.1 |
| 6,604,691 | B1 | * | 8/2003 | Thomas et al. | 239/276 |
| 7,485,788 | B2 | * | 2/2009 | Fennell et al. | 84/402 |
| 2004/0083876 | A1 | * | 5/2004 | Maegli et al. | 84/410 |
| 2007/0019404 | A1 | * | 1/2007 | Chen | 362/192 |
| 2014/0352519 | A1 | * | 12/2014 | Schmidt | 84/404 |

* cited by examiner

*Primary Examiner* — Robert W Horn

(57) ABSTRACT

One embodiment having a flexible base with a plurality of vertical holes near its perimeter, each for housing a wind chime tube, the base further having a slit cut from one of the vertical holes into the middle of the base, allowing the base to be installed in the central portion of a wind chime, thereby effectively silencing the wind chime and protecting the tubes and nearby objects. This article works on the type of chime having multiple vertical resonant tubes that are struck by a striker connected to a sail that is urged by the wind. Other embodiments are described and shown.

13 Claims, 8 Drawing Sheets

WIND CHIME SILENCER AND PROTECTOR

CROSS-REFERENCE TO RELATED APPLICATIONS

This application claims the benefit of provisional patent application Ser. No. 61/775,334, filed 2013 Mar. 8 by the present inventor, which is incorporated by reference.

BACKGROUND

Prior Art

The following is a tabulation of prior art that seems relevant:

| U.S. Pat. | | | |
|---|---|---|---|
| Pat. No. | Kind Code | Issue Date | Patentee |
| 4,967,633 | NA | Nov. 6, 1990 | Jewell |

This relates to wind chimes having vertical tubes that are struck by a central clapper or striker connected by string to a sail urged by the wind. Wind chimes are usually pleasant and enjoyable, but users might want to make them quiet and secure while leaving them in place. Wind chimes can be noisy and, if they hang near a window, they might prevent persons from sleeping or concentrating. Strong winds can cause the chimes to ring severely, and the tubes can damage the other chime tubes or nearby property. Heavy wind chimes can be difficult to take down and put back up, and doing so can be dangerous. Jewell, in U.S. Pat. No. 4,967,633 (1990), proposes a wind chime clapper support that allows the striker to be moved out of contact with the tubes; however, the tubes can still contact each other and nearby objects, especially in strong winds.

Anecdotally, the present inventor has heard of placing a rubber band around the perimeter of the collection of all the chime tubes—a string could also be tied—and pulling them inward so that they are in constant contact with the striker and each other and cannot swing freely. Doing so forces the tubes to rub the other tubes, possibly damaging them or abrading them over time with the motion of the chime. It also causes the tubes to hang at an angle and may be unsightly. It also is somewhat hard to coordinate the many moving parts so as to place a rubber band around them.

ADVANTAGES

Accordingly, several advantages of one or more aspects are as follows: to provide an item for wind chimes that holds the wind chime's striker and tubes in place so they cannot contact the striker, the other tubes, or nearby property; that can be used if the chime was not manufactured with a silencing feature; that is easy to install on and remove from the chime; that allows heavy chimes to remain hanging in their present location, thus increasing the user's safety; and that retains the chime's aesthetic appeal with the tubes hanging in their original vertical position.

SUMMARY

In accordance with one embodiment, a wind chime silencer and protector comprises a flat body or base, a slit that holds the striker in place and secures the base on the chime, and vertical holes in which to insert the wind chime tubes that are then held in place.

DRAWINGS

Figures

Reference Numerals

Figure 1A:
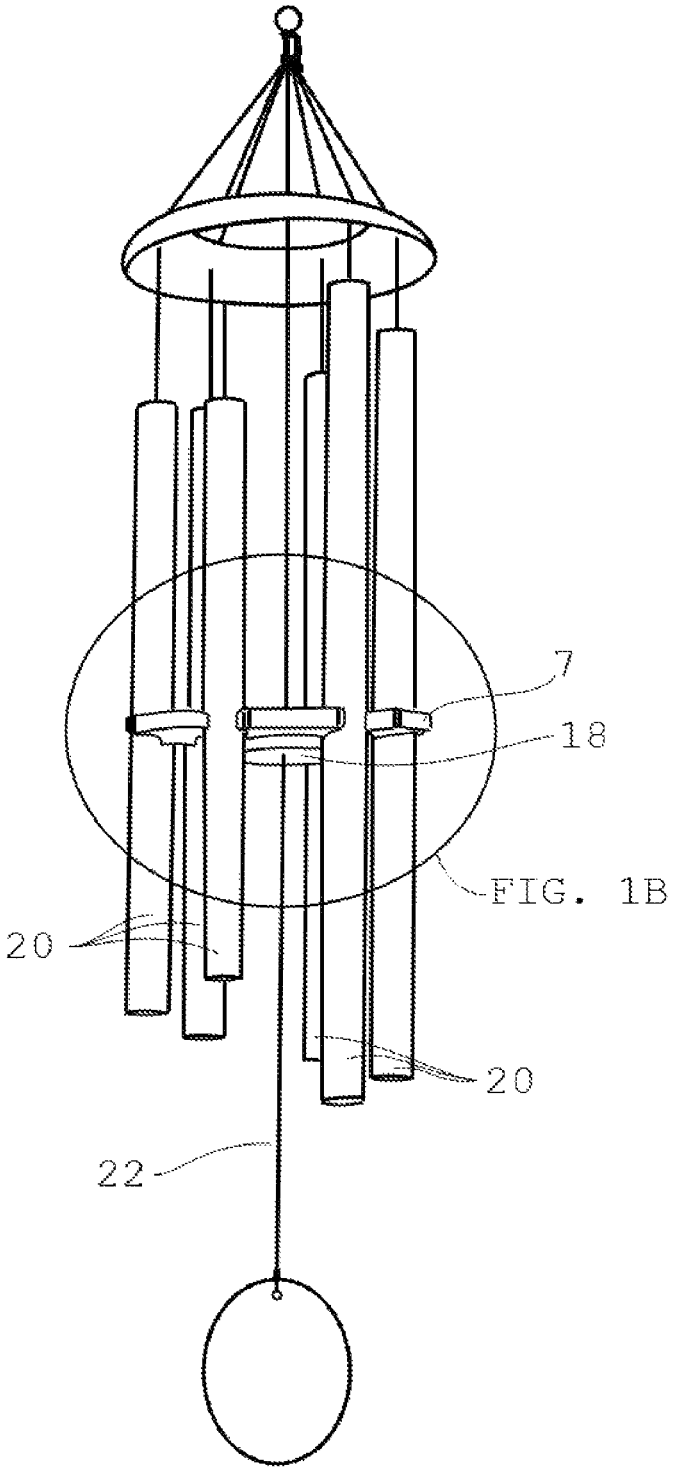
FIG. 1A is a view of a wind chime and the wind chime silencer and protector first embodiment in place resting on the striker and securing the tubes.

7 base of wind chime silencer and protector
8 slit
10 lead-in gaps
12 gripping points
14 V-shaped holes
16 cavity
18 wind chime striker
20 wind chime tubes
22 middle string
24 bottom pegs
26 large void
28 groove
30 hook-and-loop closure pieces
32 partial V-shaped holes
34 strand
36 loop patch of the hook-and-loop closure
38 end of strand—hook patch of the hook-and-loop closure
40 stretchy cord loops
42 small holes
44 top pegs

DETAILED DESCRIPTION

Figure 1B:
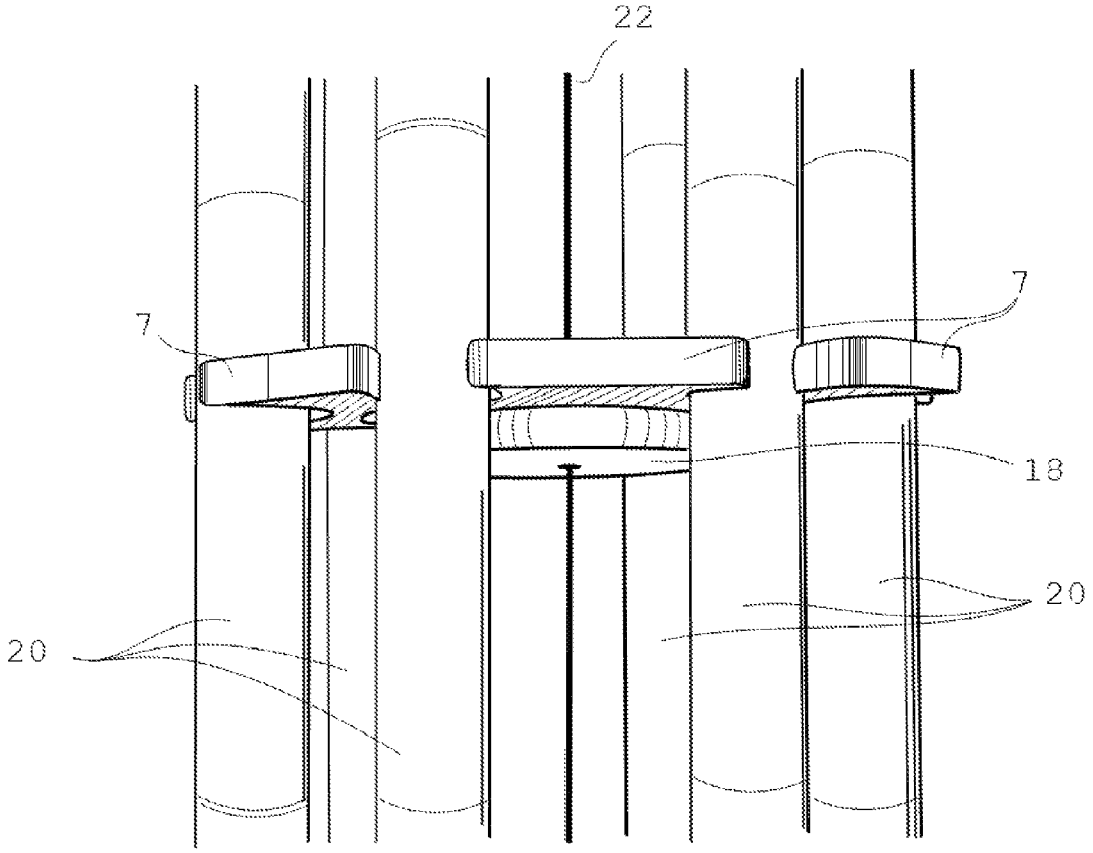
FIG. 1B is an enlarged view of the first embodiment in place on a wind chime as shown FIG. 1A.
Figure 1C:
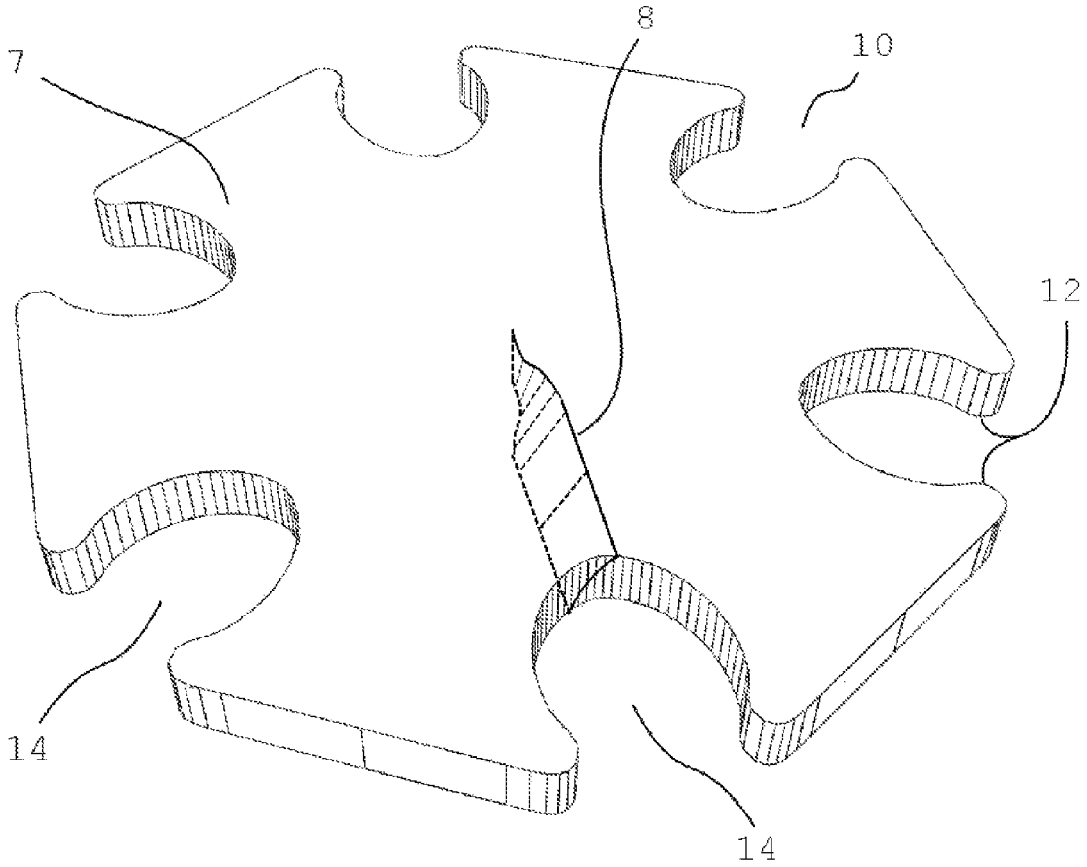
FIG. 1C is a perspective view of the first embodiment.

First Embodiment—FIGS. 1A, 1B, 1C

The first embodiment of the wind chime silencer and protector is shown in FIGS. 1A, 1B, and 1C. FIG. 1A is a view is of an entire wind chime with the base 7 in place on the chime, resting on the chime's striker 18, which is suspended on the middle string 22 and with the tubes 20 in place. FIG. 1B is an enlarged view of that shown in FIG. 1A.

FIG. 1C is a perspective view of the base 7 first embodiment with a slit 8 in which to slide the wind chime's middle string 22 that suspends the striker 18. This embodiment is hexagonal and has six lead-in gaps 10, one for each tube 20 of a six-tubed wind chime. The base has gripping points 12 leading to vertical voids or holes 14 at the edge of the base perimeter. The gripping points serve to secure the tubes in the vertical holes. The vertical holes are substantially shaped as a V or rounded U, such that the base can fit multiple sizes of wind chimes and tubes. That is, large wind chime tubes are farther away from the middle string 22 than small chimes and, once pressed into the V-shaped vertical holes, the tubes rest in the widest part of the hole, yet still hang vertically. Tubes of smaller chimes rest in the narrow portion of the V-shaped hole nearer the center of the base, yet still hang vertically. A smaller version of the wind chime silencer and protector, of substantially the same shape or design, could be manufactured to fit a variety of small- to medium-sized chimes, and another model made to fit a variety of medium- to large-sized chimes. This would be more efficient than making many base models that fit only one size chime each.

The base is cut or stamped out of a soft yet somewhat rigid material, such as a thickness of foam or rubber. The wind chime silencer could also be molded using foam or rubber by blow or compression molding. The material is compressible and is flexible so that the wind chime tubes 20 can be pushed past the gripping points 12, which serve as a detent, and into the V-shaped holes 14. The gripping points resume their shape, thus holding the tubes in place. The wind chime silencer material is, thus, soft enough that it does not damage the chime's center string or tubes. The base's material is rigid or thick enough that the portions of it that extend horizontally beyond the edge of the chime's striker 18 do not sag or droop. Viewed from the top, the wind chime silencer's shape could be round or it could correspond to the number of tubes in the wind chime. That is, for a wind chime with eight tubes, the shape could be substantially octagonal; for a chime with six tubes, it could be substantially hexagonal; and so on.

The slit 8 is cut through the base 7 at an angle or tilt from the apex of one of the V-shaped holes 14 toward the center of the base. However, when cutting the slit, a short distance from the terminus of the slit at the center of the base, the base or the cutting device is rotated or twisted such that the slit is perpendicular to or roughly vertical through the base at the terminus of the slit in the center of the base where the chime's middle string 22 rests. This tilted slit allows the user to easily begin to fit the base between two tubes of the wind chime when installing it on the chime. The twisted portion near the terminus of the slit keeps the striker 18 in the center of the chime because the middle string cannot move horizontally, thus preventing the striker from contacting the tubes 20 and keeping the base securely on the chime's middle string. A purely horizontal movement of the base is not sufficient to tilt the base as is required to remove the base from the center of the chime. As such, the tilted slit and the twist near its terminus serve as a means for keeping the striker in place and for securing the base on the wind chime.

Operation

First Embodiment—FIGS. 1A, 1B, 1C

To install the chime silencer and protector on the wind chime, the user tilts the base 7 at an angle between two of the wind chime's tubes 20 at a level above the striker 18, aligning the tilted slit 8 with the chime's middle string 22. The user then holds the string 22 and pushes the base toward the middle of the chime sliding the string into the slit 8 as far as it will go, and as the string approaches the terminus of the slit, the user rotates the base 7 to horizontal and rests the base on the top of the striker 18. The user then positions a chime tube 20 at a lead-in gap 10 and pushes the tube past the gripping points 12 and into the V-shaped hole 14. The gripping points grip and secure the tube. For each of the remaining tubes, the user then repeats this step of pushing the tubes past the gripping points into its corresponding hole. The striker 18 and tubes 20 are now held in place. The striker cannot hit any of the tubes; nor can the tubes hit other tubes or nearby property. The chime is now silenced, or greatly quieted, and protected.

To remove the base from the chime, the user reverses the above procedure: pulling the tubes 20 outward and free from the V-shaped holes 14, holding the chime's middle string 22 and pulling the base 7 outward from the middle portion of the chime and rotating the base from horizontal to tilt following the contour of the slit 8.

Detailed Description

Figure 2A:
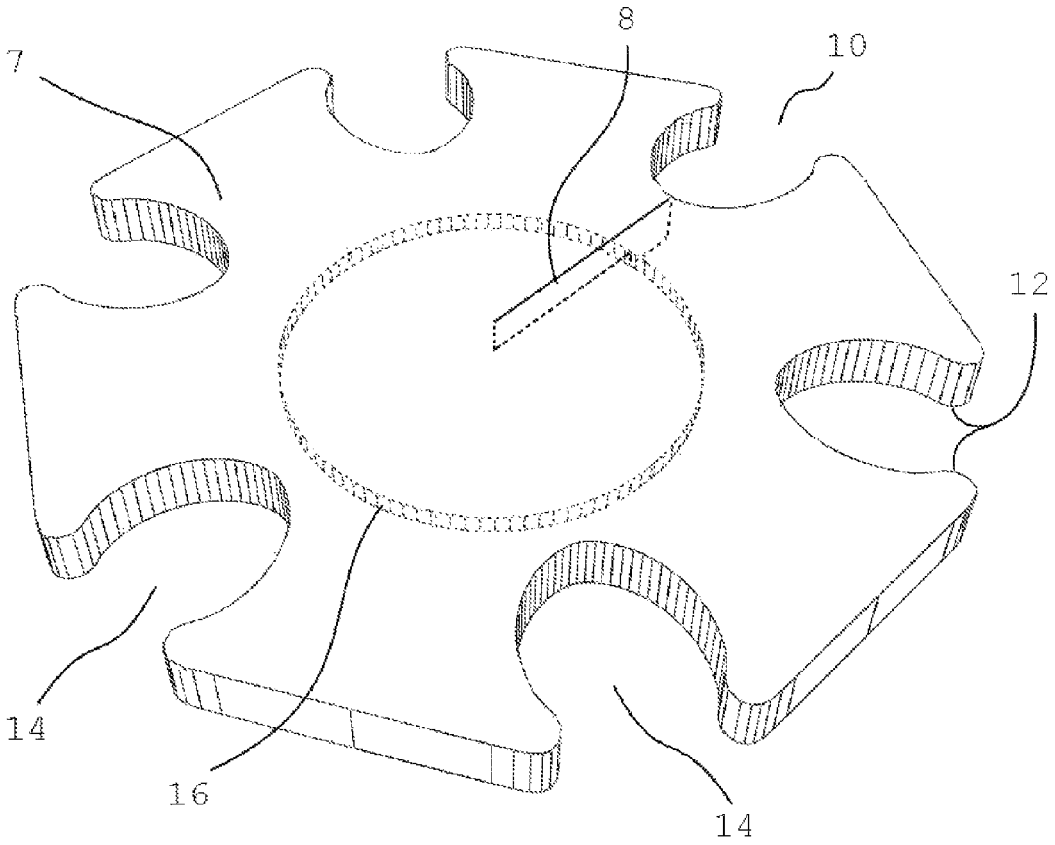
FIG. 2A is a view of the second embodiment.
Figure 2B:
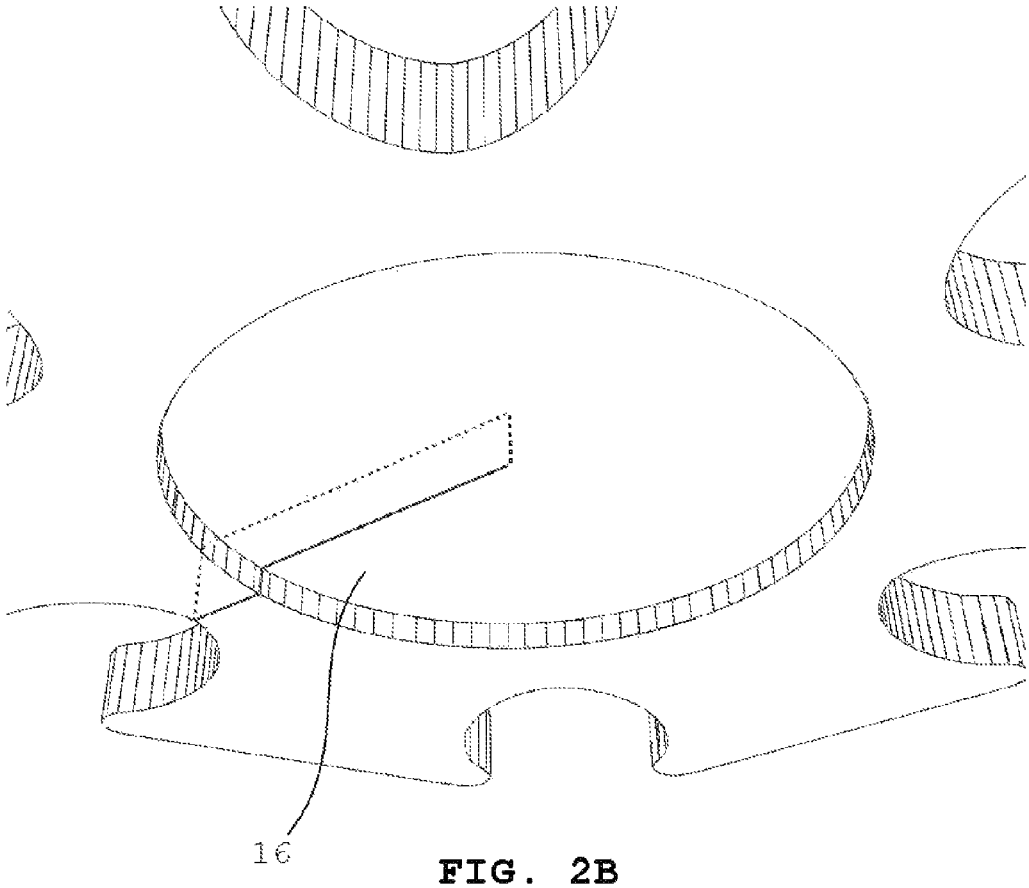
FIG. 2B is an enlarged view of the bottom of the second embodiment.

Second Embodiment—FIGS. 2A and 2B

FIG. 2A is a perspective view of the second embodiment similar to the first embodiment but with a cavity 16 cut, bored, or ground partially into the bottom of the base's thickness. The cavity is sized so that it fits on and around the striker 18 of the wind chime, thereby securing the base on the striker and keeping it in place. The slit 8 could be tilted and have a twist, as described above for the first embodiment, or it could be vertical.

FIG. 2B shows a closer view of the cavity 16 from below the base.

Operation

Second Embodiment—FIGS. 2A and 2B

Operation of the second embodiment is just as for the first embodiment, but the cavity 16 fits around or roughly encompasses the striker 18 to hold it in place.

Detailed Description

Figure 3:
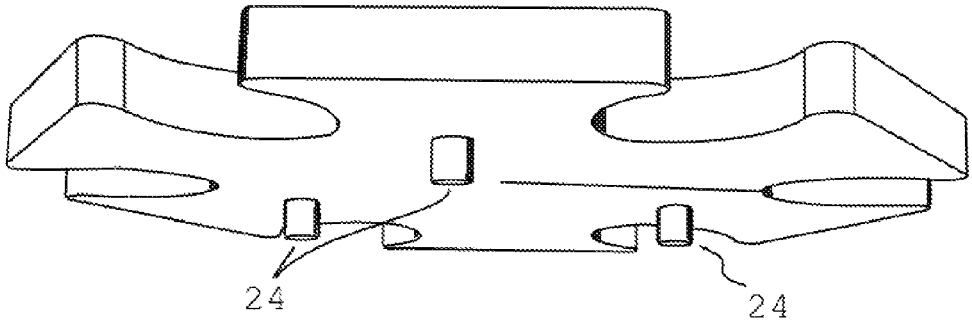
FIG. 3 is a perspective view of the bottom of the third embodiment similar to the second embodiment but with a number of pegs protruding from the bottom.

Third Embodiment—FIG. 3

FIG. 3 is a perspective view of the third embodiment similar to the second embodiment but with a number of pegs 24 glued to, or molded as part of, the bottom of the base 7 instead of the cavity 16 that is shown in FIG. 2B. The pegs are spaced such that their innermost surfaces slightly grip the striker and keep it in place. The slit 8 could be tilted and have a twist, as described above for the first embodiment, or it could be vertical.

Operation

Third Embodiment—FIG. 3

Operation of the third embodiment is just as for the first embodiment, but the pegs 24 fit around or roughly encompass the striker 18 to hold it in place.

Detailed Description

Figure 4:
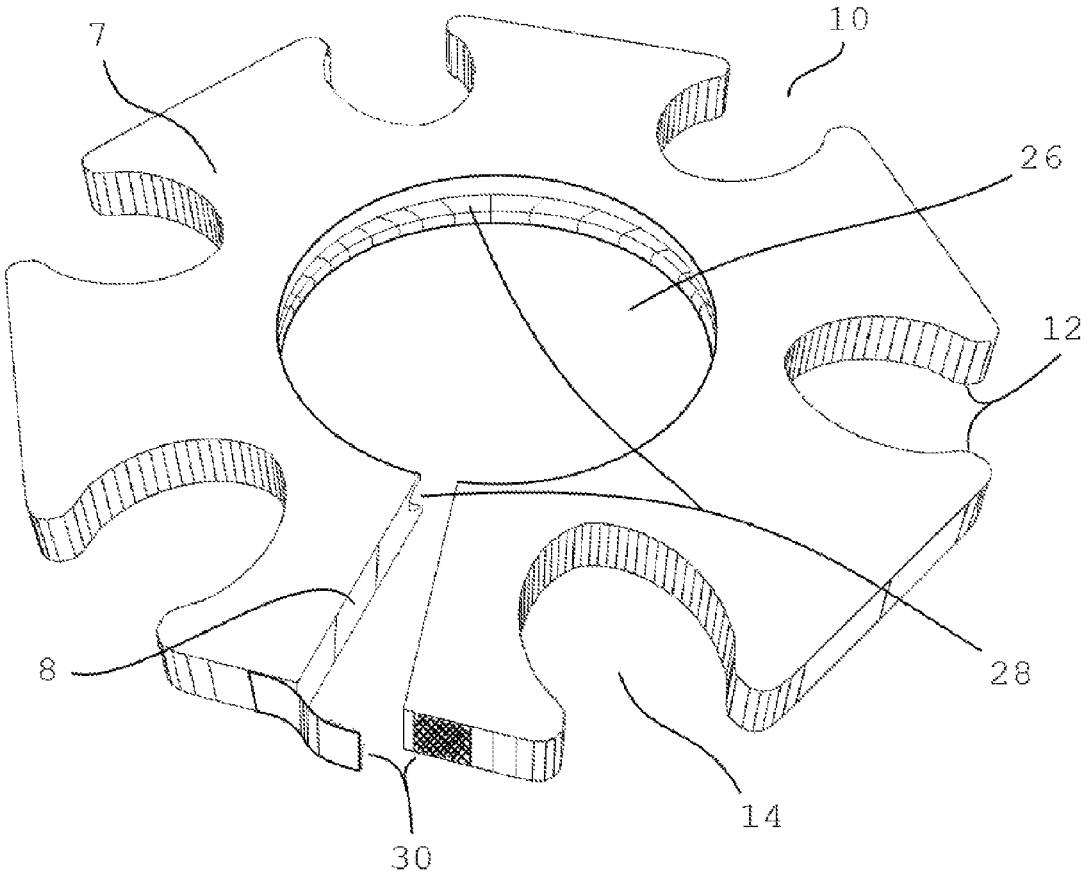
FIG. 4 is a perspective view of the fourth embodiment with a large void and groove to fit around the striker and with hook-and-loop fasteners to attach the two ends of the base to each other.

Fourth Embodiment—FIG. 4

FIG. 4 is a perspective view of the fourth embodiment, which is made of the same or similar material as the first embodiment. The base 7 has a slit 8 leading to a large void 26 in the center, effectively allowing the base to be spread open as in the shape of a C and having two ends. The large void 26 has a groove or channel 28 cut into its edge that fits around the circumference of the wind chime's striker. The two ends of the base attach to each other using matching hook-and-loop pieces 30 which are glued to the base. When in place, the base grips the striker and forms a shape that is similar to the first embodiment, but the striker composes the middle of the base.

Operation

Fourth Embodiment—FIG. 4

The user installs the base 7 into the middle portion of the chime sliding the chime's middle string 22 through the slit 8 into the large void 26 and fits the base around the circumference of the chime's striker 18 so that the groove 28 fits along the striker's edge. The user then fastens the two ends of the base to each other by attaching the matching hook-and-loop fasteners 30 so that the base grips the striker. The user then positions a tube 20 at a lead-in gap 10 and pushes the tube past the gripping points 12 and into the hole 14, which grips and secures the tube. The user then repeats this step for the remaining tubes. The striker 18 and tubes 20 are now held in place and cannot hit any of the other pieces or nearby property.

Detailed Description

Figure 5:
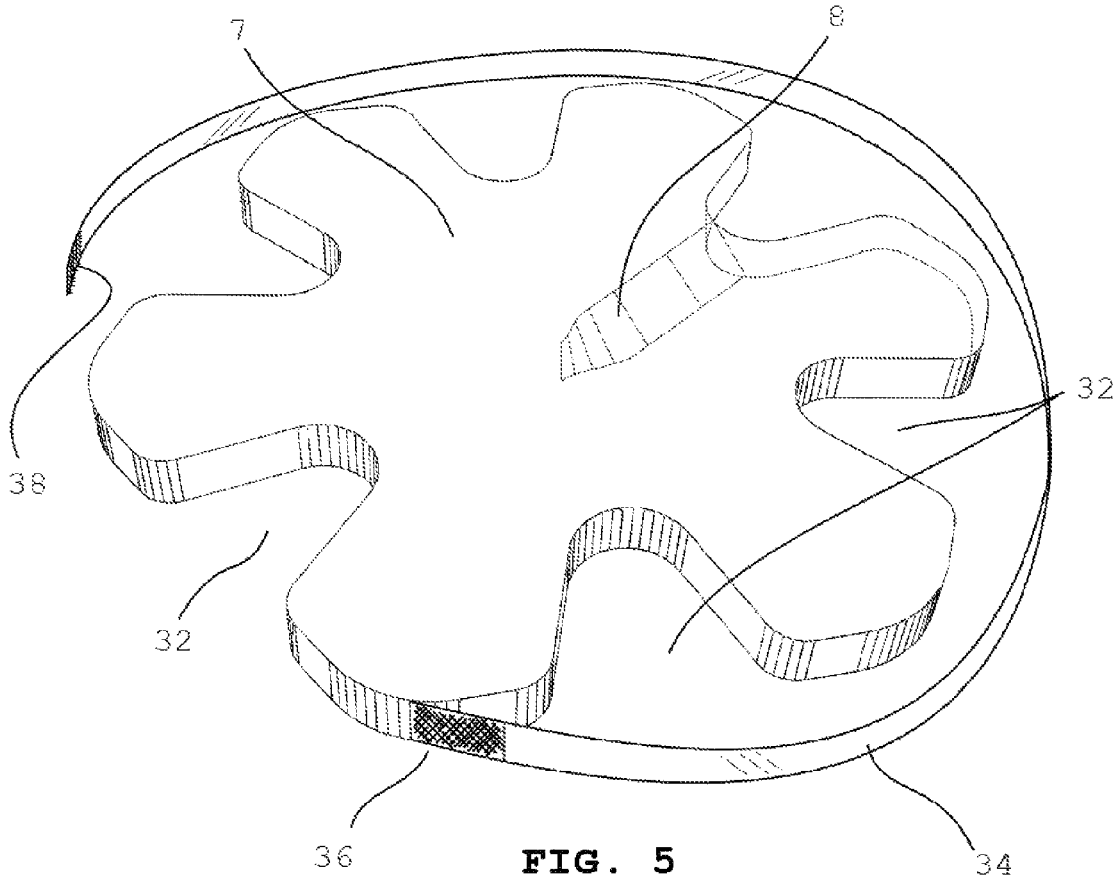
FIG. 5 shows the fifth embodiment with one holding strand with hook-and-loop fasteners.

Fifth Embodiment—FIG. 5

FIG. 5 shows a fifth embodiment similar to the first embodiment but with only partial holes 32, again which are V-shaped, in which the wind chime tubes rest. Therefore, the base 7 has a smaller diameter than the first four embodiments described. The base could be made of the same material as the first embodiment; however, because the base does not have to flex or compress, it could be cut from a more rigid material such as wood or plastic, or it could be molded from plastic or foam or rubber that is relatively more rigid. Between two partial V-shaped holes 32 attached to the side of the base perimeter using glue or other adhesive is one long, flexible strand 34 of strapping or webbing, which could be made of nylon or a stretchy or somewhat stretchy material. The strand is long enough that it can encircle all the wind chime tubes 20 when in place on the base. On the outside of the strand, near where it is attached to the base, is a patch 36 of a hook-and-loop pair of fasteners, which is glued or sewn to the strand. At the loose end on the inside of the strand is the matching patch 38 of the hook-and-loop fasteners, which is also glued or sewn to the strand.

Operation

Fifth Embodiment—FIG. 5

The user slides the base 7 into the middle portion of the chime between the tubes, slipping the chime's middle string 22 into the slit 8, and resting the base onto the striker 18. The user places each chime tube 20 in its respective partial V-shaped hole 32, then takes the long strand 34, wraps it around the outside portion of all the tubes, and attaches the end of the strand 38 to the strand itself with the hook-and-loop pair of fasteners 36. As the strand is made snug, it pulls all the tubes inward. When the strand is attached, the tubes are held secure in their respective partial V-shaped holes 32 and cannot touch other tubes or the chime's striker.

Detailed Description

Figure 6:
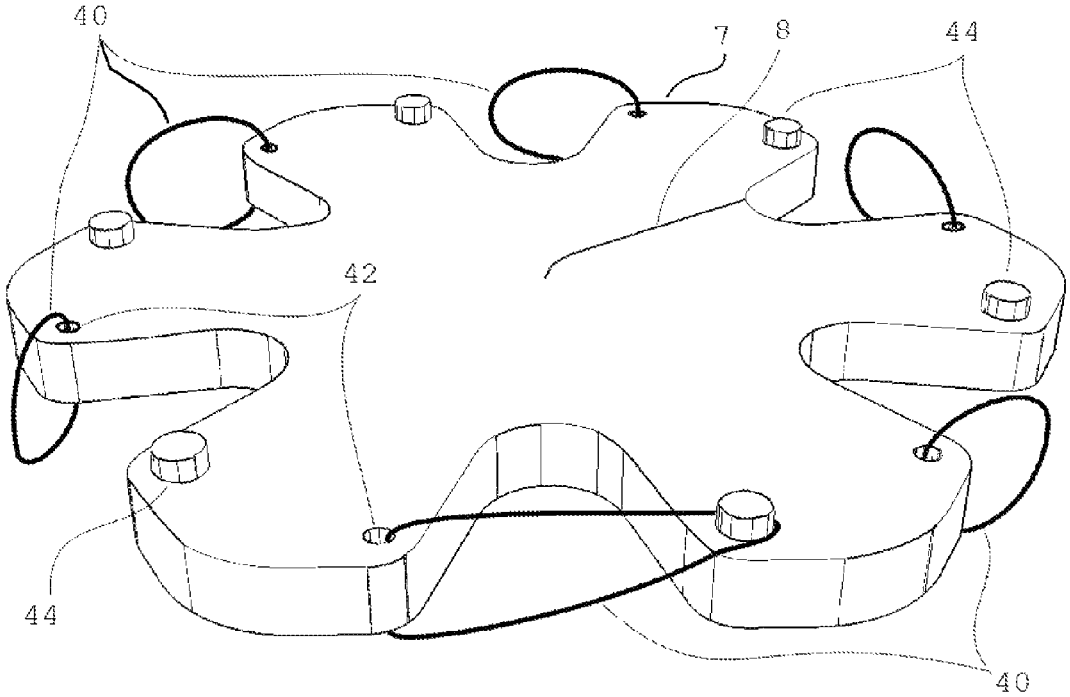
FIG. 6 shows the sixth embodiment with multiple holding loops through small holes and pegs on the top.

Sixth Embodiment—FIG. 6

FIG. 6 shows a sixth embodiment similar to the fifth embodiment with the smaller base 7 diameter and made of the same material choices as described for the fifth embodiment. In this embodiment drilled vertically through the base on one side of each large partial hole 32 are small holes 42. Through each small hole is threaded a loop made of a flexible and stretchy cord 40. The loop is made by tying in a knot the two ends of the cord and pressed into the hole 42. The loop could also be made by clamping together or fusing together the two ends of the cord. Each cord can be extended around the outer portion of a chime's tube and attached to a peg 44 that is glued to the base on the opposite side of the partial hole 32 from the small hole 42. The slit 8 could be tilted and have a twist, as described above for the first embodiment, or it could be vertical.

Operation

Sixth Embodiment—FIG. 6

The user slides the base 7 into the middle portion of the chime between the tubes, slipping the chime's middle string 22 into the slit 8, and resting the base onto the striker 18. The user places each chime tube 20 in its respective partial hole 32, then takes a stretchy cord 40, leads it around the outside portion of a chime tube, then slips the cord over a peg 44 on the base on the opposite side of the partial hole, thus securing the tube in the partial hole by pulling it inward. The user then repeats the attachment of the stretchy cord around each remaining tube.

CONCLUSION, RAMIFICATION, AND SCOPE

Accordingly, the reader will see that at least one embodiment of the wind chime silencer and protector provides more protection and that it is easily installed on and removed from the wind chime.

Although the description above contains many specificities, these should not be construed as limiting the scope of the embodiments but as merely providing illustrations of some of several embodiments. For example, the base could have other shapes such as circular or polygonal; the base profile could be rounded or have shapes other than flat; the lead-in gaps and gripping points could have other shapes; the V-shaped holes could have other shapes, such as to fit wind chime tubes that are square rather than round; the slit could have other angles or it could be cut to have a zig-zag, curl, or detent near its terminus to further impede the striker from sliding out of place from the center; the hook-and-loop patches could be longer than pictured or be replaced by snaps, plastic side-release clips, or other attaching devices; the strand could be a string with a loop at its terminus that would slide onto a hook or peg; the strand and pegs or hooks could be attached to the top or bottom of the base; the size of the base could be much smaller such that the partial vertical holes are not very pronounced and the perimeter has merely a small undulating wave shape; the base could have a small hole drilled through it that allows the user to hang it on a nail or peg when it is not in place on a chime; the base could have instructions, identification, or other text printed, engraved, molded, or embossed on its flat surfaces, and so on.

Thus, the scope of the embodiments should be determined by the appended claims and their legal equivalents, rather than by the examples given.

I claim:

1. An article comprising:

a. a base having a plurality of vertical holes near said base perimeter, each with an opening through which to insert a tube of a wind chime, b. a first means for holding the striker of said wind chime in place and for securing said base on the wind chime, and c. a second means for securing said wind chime tubes in said vertical perimeter holes, whereby when installed on said wind chime, said chime's striker and tubes are prevented from contacting each other or nearby objects, thus protecting and silencing or quieting said chime tubes.

2. The base of claim 1 wherein said base perimeter shape is predetermined by the number of sides corresponding to the number of said chime tubes that said base is to accommodate.

3. The base of claim 1 wherein said first means for securing said base on said wind chime include a tilted slit with a twist near its terminus.

4. The base of claim 1 wherein said first means for securing said base on said wind chime include a cavity in the bottom surface of said base.

5. The base of claim 1 wherein said first means for securing said base on said wind chime include pegs protruding from the bottom surface of said base.

6. The base of claim 1 wherein said first means for securing said base on said wind chime include one large central void.

7. The base of claim 6 wherein said large central void has a groove in its perimeter.

8. The base of claim 1 wherein said second means for securing said wind chime tubes in said vertical perimeter holes include lead-in gaps on the edge thereof and a gripping point adjacent to and communicating with said gap.

9. The base of claim 1 wherein said second means for securing said wind chime tubes in said vertical perimeter holes include a plurality of small vertical holes through said base near the edge of the perimeter holes.

10. The base of claim 9 wherein said second means for securing said wind chime tubes in said holes include a plurality of stretchy cord loops that are threaded through said small vertical holes.

11. The base of claim 9 wherein said second means for securing said wind chime tubes in said holes include a plurality of pegs protruding from the top of said base, one opposite said perimeter hole from each said small vertical hole.

12. The base of claim 1 wherein said second means for securing said wind chime tubes in said vertical perimeter holes include a strand attached to the said base that is long enough to extend around the perimeter of the base.

13. The base of claim 12 wherein said strand has a pair of hook-and-loop patches, one patch on the outside of the strand near where it attaches to said base, the other patch on the inside of said strand near said strand's terminus.

* * * * *